United States Patent [19]

Baker

[11] 4,164,351

[45] Aug. 14, 1979

[54] DIE-RESEMBLING GAME CUBE

[76] Inventor: Exzelon F. Baker, 3933 Cedarwood Pl., Cincinnati, Ohio 45213

[21] Appl. No.: 904,786

[22] Filed: May 11, 1978

[51] Int. Cl.[2] ..... A63F 9/04

[52] U.S. Cl. ..... 273/144 B; 273/146

[58] Field of Search ..... 273/146, 144 B, 144 R, 273/147, 138 R, 58 E, 58 F, 145 C

[56] References Cited

U.S. PATENT DOCUMENTS

| | | | |
|---|---|---|---|
| D. 142,576 | 10/1945 | Morris | 273/146 X |
| 693,821 | 2/1902 | De Ford | 273/138 R |
| 1,436,909 | 11/1922 | Roberts | 273/145 C |
| 2,526,123 | 10/1950 | Dawson | 273/146 UX |
| 3,074,718 | 1/1963 | Modica | 273/138 R X |
| 3,204,345 | 9/1965 | Buckner | 273/145 C X |
| 3,495,832 | 2/1970 | Thomassen-Behle | 273/146 |
| 3,679,212 | 7/1972 | Smith | 273/144 B |
| 3,785,651 | 1/1974 | Smith | 273/146 X |

FOREIGN PATENT DOCUMENTS

| | | | |
|---|---|---|---|
| 75700 | 6/1894 | Fed. Rep. of Germany | 273/146 |
| 801077 | 12/1950 | Fed. Rep. of Germany | 273/146 |
| 607302 | 3/1926 | France | 273/138 R |

*Primary Examiner*—Richard C. Pinkham
*Assistant Examiner*—Arnold W. Kramer
*Attorney, Agent, or Firm*—Wood, Herron & Evans

[57] ABSTRACT

A hollow, transparent game cube device which is capable of being thrown or rolled on a playing surface to come to rest and randomly settle on one of its faces is disclosed. The interior faces of the cube have from one to six shallow, ball-receiving pockets so arranged that when the cube is viewed from without it resembles a traditional die. The cube contains a number of unconstrained balls which may randomly fall into the ball-receiving pockets in the inner surface of the bottom face of the cube when the cube comes to rest. Each ball has a distinct identification visible through the cube, for example, a distinguishing color, numeral, letter or other symbolic indicia, or any combination thereof. Numerous and diverse amusing and entertaining games of chance may be played using one or more of the cube devices depending for outcome on the permutations and combinations of final cube position and disposition of balls in the ball-receiving pockets after tossing of the cube or cubes in play.

6 Claims, 3 Drawing Figures

DIE-RESEMBLING GAME CUBE

BACKGROUND OF THE INVENTION

This invention relates to a new and improved game cube and, more particularly, to a game cube comprised of a transparent cube with each face of the cube having shallow, ball-receiving pockets or indentations in the inner surface thereof of from one to six arranged in a conventional die-spot pattern so that the cube itself resembles a single die and a plurality of balls within the cube.

Games of chance involving, per se, a single die or some given plurality of dice are well known. These include adaptations wherein the die or dice are played in conjunction with various playing aids. Numerous variations employing a die or dice have been developed including those that employ dice contained in assemblies and visible from without. By way of illustration, U.S. Pat. No. 1,436,909 to Roberts discloses a chance device wherein a rim with glass sides is provided with a series of grooves for receiving a ball to indicate whether the value shown on the die or dice inside the rim is to be added or subtracted from the player's score. Both U.S. Pat. No. 1,593,907 to Madan and U.S. Pat. No. 2,526,123 to Dawson show transparent devices having one or more dies inside. In particular, the Dawson patent shows a transparent cube wherein each face is provided with a number of spots from one to six to simulate a normal die. However, the interior of the box is divided into eight compartments, each of which is provided either with a numbered or lettered cube of its own. U.S. Pat. No. 2,528,029 to Brown is another example of a transparent cube containing a pair of dies inside; but it is for playing of a simulated baseball game.

While the aforementioned devices are of interest, none is directed to the concept of providing a transparent device which itself simulates a traditional die and has a plurality of ball-receiving recesses or pockets and balls inside for the execution and playing of games of chance.

SUMMARY OF THE INVENTION

This invention consists of a unique game cube and method of play wherein the outcome of the game depends upon the permutations and combinations of final cube position after tossing of the cube on the playing surface and the number and/or particular balls randomly falling in and being captured by the ball-receiving pockets in the bottom face of the cube. In accordance with the principles of this invention, a hollow, transparent cube formed of plastic or other suitable material of construction is provided with the interior surfaces of each cube face having from one to six shallow, ball-receiving pockets therein being visible from without and being arranged in conventional die orientation and sequence so that the cube itself is a die. Contained in the game cube are a number of balls, preferably six, receivable at random in the pockets. The balls may be colored, numbered, lettered, etc., as desired for playing a particular game. In any event, however, the outcome of the game is dependent on the combination of: (i) the randomness of the face upon which the cube comes to rest when rolled or thrown on a playing surface, and (ii) the randomness of which the number of balls or particular balls come to rest in the ball-receiving pockets. This combination of probabilities permits a variety of amusing and entertaining games of chance to be played with a single game cube. It will be recognized, of course, that more than one game cube may be employed, if desired.

Accordingly, it has been an objective of the present invention to provide a die-resembling, transparent game cube containing a number of balls receivable at random in ball-receiving pockets in the interior surfaces of the cube faces when the cube is thrown or rolled on a playing surface. To this end, a game device has been provided comprising a plural-faced, transparent, enclosed hollow cube which is adapted to be readily rolled or thrown formed of six edge-joined substantially uniform square, flat face sections with one of said face sections providing the bottom face of the cube when it is resting in any given position on a playing surface, and from one to six ball-receiving pockets in the interior surface of the face sections so arranged that the cube itself is a conventional die, there being a number of unconstrained balls within the cube, each of which is adapted to fit in and be captured by any given pocket in the bottommost face section of the cube when the cube comes to rest after being thrown on a playing surface.

It has further been an objective of the present invention to provide a game device as described wherein the outcome of the game depends on the permutations and combinations of the face upon which the cube lands when rolled or thrown and the number of balls or particular balls which land in the pockets in that face.

It has been another objective of the present invention to provide the balls with distinct and differentiating identifications visible through the cube, for example, a distinguishing color, numeral, letter or other indicia or any combination thereof permitting the play of various games depending upon where the player desires to employ none, some or all of the indicia.

It has been a still further objective to provide a die-resembling, transparent game cube wherein the cube can be opened to add, subtract or change balls therein to change the game which may be played.

Other objects and advantages of the invention will become apparent from the following detailed description of the invention taken in conjunction with the accompanying drawings.

DETAILED DESCRIPTION OF THE INVENTION

Figure 1A:
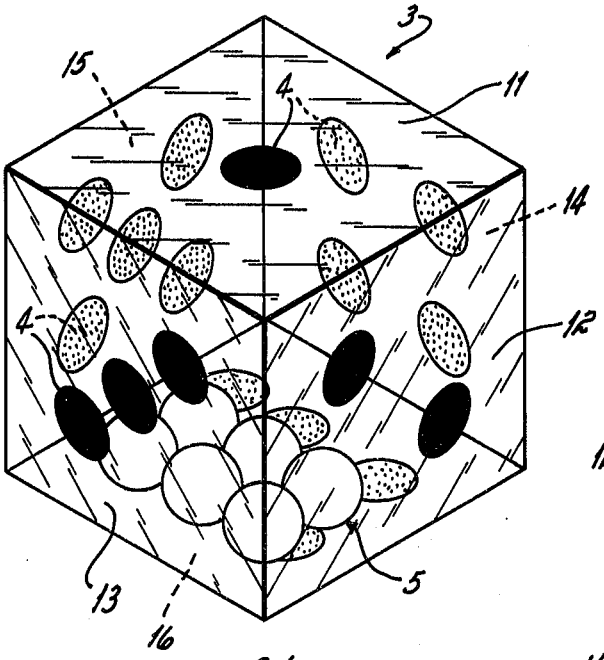
FIGS. 1A and 1B are perspective views of the game cube of the present invention taken from above the cube and from below the cube, respectively.
Figure 1B:
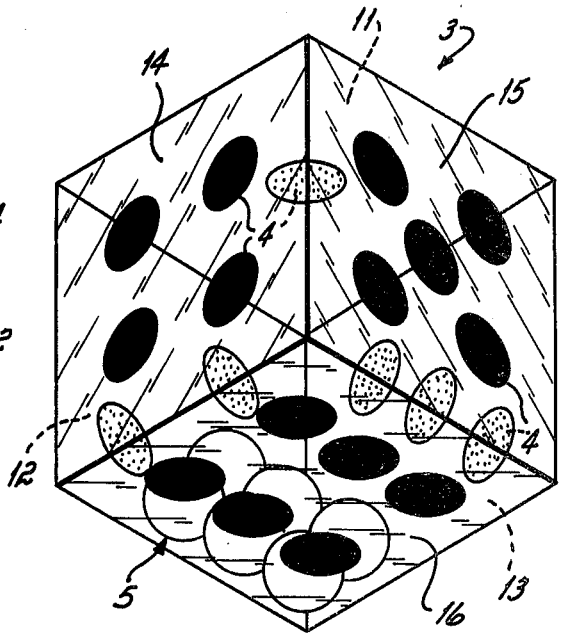

Referring now to FIGS. 1A and 1B of the accompanying drawings, there is shown a game cube having six sides or faces, each of a generally square, flat outline respectively identified as faces 11, 12, 13, 14, 15 and 16. The faces 11–16 are joined at their edges defining an interiorly void or hollow cube. The faces may be formed of a plastic such as Lexan or other transparent material of construction so that the interior of the cube is visible through any one of the faces.

The view in FIG. 1A is of one orientation of the cube with faces 11, 12 and 13 directly and primarily visible and the associated companion faces 14, 15 and 16 secondarily discernible through the transparency of said nearest faces 11, 12 and 13. To help better identify and locate the respective faces, the lead lines from the reference numerals designating those directly visible in FIGS. 1A and 1B are solid while those designating the faces seen through those faces directly visible are partly broken. The view in FIG. 1B is of the same cube but of another orientation such that faces 14, 15 and 16 are directly visible while faces 11, 12 and 13 are secondarily visible through the transparency of the primarily visible faces 14, 15 and 16.

The cube faces 11–16 are generally uniform, sheet-like, planar sections fabricated into a centrally void or hollow or empty body. In this connection, it is possible to construct a cube by assembling and joining together along their interconnecting edges the several face sections that make up the cube. This can be achieved by use of adhesives, heat sealing, or other techniques known in the art. The cube may also be made in interfitting half or quarter-body components that are so prepared and joined together to complete an entire body assembly. Regardless of the method of construction, it is highly desirable that the cube be balanced so that the probability of its landing on any one of its faces is equal.

Each of the cube faces 11–16, inclusive, have one or more interior indentations or relatively shallow ball-receiving pockets 4 formed therein. The interior recesses are shaped to conform to the spherical surface of balls 5 contained in the cube 3 for ready reception thereof. The balls 5 are freely movable within the cube and may roll on the cube faces until they land in a pocket 4. However, it is possible and sometimes desirable for the pockets to be of other configurations or to even be complete apertures or holes through the face in which they are situated. Of course, the major diameter of the pocket or equivalent opening for ball reception and capture must be less than that of the balls. In any event, the ball receiving pockets are visible through the cube faces.

As illustrated in FIGS. 1A and 1B, the interior pockets in each of the respective cube faces are circular and progressive in number from one to six and patterned after conventional spot placement in a traditional die face configuration. Thus, the interior surface of face 11 has a single central pocket 4; while face 12 has two of the pockets 4; face 13, three; face 14, four; face 15, five; and face 16, six; with face 11 being opposite face 16, face 12 being opposite face 15, and face 13 being opposite face 14. The pockets 4 may be painted or colored to make the "spots" more readily discernible on the outside of the cube.

As mentioned, the cube is made of a suitable transparent material. In this regard, it must be adequately clear to allow easy and unmistakeable viewing and observation of the interior ball pockets and balls. While other materials are possible to employ, the body is thus conveniently made of an adequately strong, clear plastic substance, such as an acrylate ("Lucite," for example), styrene polymer plastic, ethyl cellulose (such as "Ethocel"), celluloid and the like or equivalent materials. And, even though as normally assembled the fabricated device is made to be integrally sealed and not readily dismantled, it can be made if such construction is wanted so as to have one easily openable or dismountable face to permit removal, addition or replacement of the balls therein contained.

The cube can be of any desired proportions, it merely being necessary for it to be readily throwable and to roll well upon tossing and for the respective dimensional sizes of the cube and the balls contained therein to be appropriately co-related to allow free movement of the balls and easy and noninterfering settlement of the balls in the pockets so that the number and the particular balls falling in the pockets when the cube comes to rest after throwing is truly random. In the embodiment shown in FIGS. 1A and 1B, the cube 3 contains six balls 5 permitting each ball pocket of face 16, which contains the largest number of pockets, to be filled if the cube lands with that face down. Of course, capture of each available ball in a pocket in the bottom face does not always happen upon each play of the device; this being a matter of chance. The cube may have the size of any normal style of dice or as much larger as desired for any given styling or effect. Relatively large-size cubes have been found to be quite attractive for many games to be played and uses to be made therewith.

Figure 2:
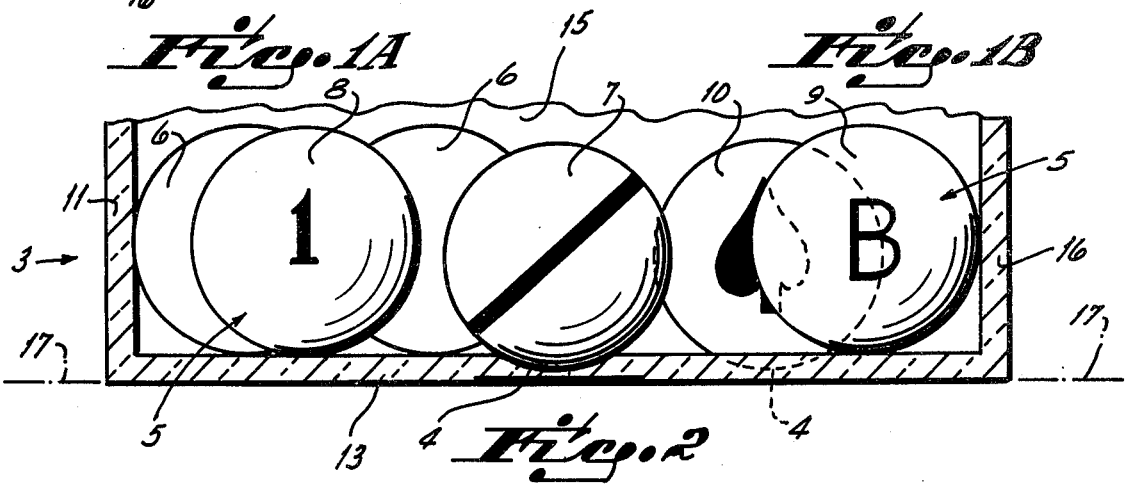
FIG. 2 is an elevational view, broken away and partly in cross-section, of the lower portion of the cube shown in FIGS. 1A and 1B showing a number of differently identified balls, some of which have landed in the ball-receiving pockets in the bottom face of the cube as it lies at rest after throwing.

Referring now to FIG. 2, the cube 3 is illustrated in a position wherein its bottom or lowermost face 13 is resting after its toss on a level, game-playing surface or ground base 17 over which it is thrown and along which it may roll before stopping. In this position, some of the balls 5 have settled in the pockets 4 on the inner side of face 13. Others, as shown, have not been so captured. At this point, the results of any given roll are determinable by observation and reckoned; according to the applicable rules and countings for any given game being played, by the disposition and final location (or not) of particular balls in the pockets in the face 13 and the number of pockets in face 13 or, if desired, its opposing face 14.

The balls 5 may be plain and undistinguished or to suit scoring the games to be played may optionally be color coded or otherwise marked for individual identification and characterization and/or possible value assignment for some specific game or game variation to be played. Thus and by way of example, ball 6 may be plain or colored; ball 7 may be striped in any desired color on a plain or contrastingly colored background; ball 8 (plain or colored) may be numbered; ball 9 (plain or colored) may be lettered; ball 10 (plain or colored) may have some symbol thereon such as the playing card sort of "spade" shown (or a "club", "diamond" or "heart" to follow standard suit designations) or it may bear other markings or indicia and so forth. Likewise the ball-retaining recesses may also be color coded and/or bear other numbers, letters, or symbols for application in cooperation with the balls for scoring any given game to be played. This is not particularly illustrated in the drawing but is readily comprehensible from the simple explanation thereof.

The numerous and varied games that may be devised and played with the game cube 3 may thus generally comprise combinations of the number of spot-simulating pockets on the face of the cube which is down, the number of balls occupying the pockets, the color, number or other designation of the balls in the pockets, the color or number or other designation of the pocket in which the balls rest, and so on and so forth. In each case, however, at least two probabilities are involved—one being the face of the cube which lands down after tossing of the cube and the other being the number of pockets occupied by the balls. Although these two probabilities are independent, it may be seen that they are interrelated in that the total number of pockets available for occupancy depends on the particular face which lands down. Thus, although the probability of any one face landing down is equal for all faces there is a higher probability that the one pocket in face 11 will be occupied by one of the six balls in the cube if that face lands down than there is of all six balls landing in the pockets in face 16 if that face should land down. Add to these probabilities, the probability that any given ball bearing an indicia will land in a pocket and the source of the amusement and the numerous and various games that may be played becomes apparent. Examples of these games will now be described.

EXAMPLES

The variations and number of games playable with game cube pursuant to this invention are many and, in some instances, accessories may be employed to implement the resulting combinations on rolling the game cube that determine in the play the winning, losing and so forth in the undertaken chance.

For example of the latter sort of game, a game bearing some analogy to roulette may be played with any associated play-making board having delineated numbered (or otherwise designated) and colored spaces or blocks in which a winning placement is determined by the resultant combination of color and number or total achieved after settlement of colored or numbered balls in colored numbered pockets after throw or cast of the cube.

Many poker-type and other sorts of card-imitating games with colored, numbered (and/or "suit" marked) balls and pockets in the cube may be played, e.g., by determining winning "hands" according to color and the addition of digits on the balls landing in the pockets adding, if desired, the number of pockets in the upmost face.

Games patterned after pool or billiards are possible by using numbered balls and identified recesses (representing "pockets") so as to get scores by the result of certain balls going into certain holes, etc. Modifications are possible using solid colored and striped balls coupled with "call your shot" requirements.

Of course, dice-rolling simulations can be had by use of a cube, for example, having numbered balls and recesses and "shooting" for points or totals, with "crap out" possibilities includable, and so forth. The simplest form of dice rolling is adding the number of balls landing in the pockets to the number of pockets in either the top or bottom face to give a total point.

Domino-like adaptations are readily possible using, by way of illustration, the balls and their resultant positions to count as the left side of a domino and the unfilled, for example, pockets in the flat down side of the cube as the right side of the domino.

It will be recognized that many variations and modifications can readily be made in embodiments heretofore described in accordance with the present invention without substantially departing from its apparent and intended spirit and scope.

What is claimed is:

1. A game device comprising:

a hollow, transparent cube, the interior faces of said cube having from one to six ball-receiving pockets therein so disposed that the cube resembles a die when viewed from the exterior thereof, one of said faces providing the bottom face of the cube when it is resting on a playing surface, and a plurality of balls in said cube, each said ball being adapted to fall at random and be captured by one of said ball-receiving pockets in said bottom face of the cube when the cube comes to rest after having been thrown on a playing surface.

2. The game device of claim 1 wherein said ball-receiving pockets are in the form of shallow, circular indentations.

3. The game device of claim 1 wherein there are six balls in said cube.

4. The game device of claim 1 wherein each said ball individually bears a distinguishing means of identification thereon.

5. The game device of claim 1 wherein each said pocket individually bears a distinguishing means of identification.

6. The game device of claim 1 wherein at least a portion of said balls individually bears a distinguishing means of identification, and at least a portion of said pockets individually bears a distinguishing means of identification thereupon.

* * * * *